US006663541B1

(12) United States Patent
Yang

(10) Patent No.: US 6,663,541 B1
(45) Date of Patent: Dec. 16, 2003

(54) EXERCISE MACHINE PROVIDED WITH MEANS TO ENABLE A USER THEREOF TO ASSUME INTERCHANGEABLY A SEATED POSITION AND AN INVERTED POSITION

(75) Inventor: Hsin-Yen Yang, Taichung Hsien (TW)

(73) Assignee: Uniasso Enterprises Co., Ltd., Taichung Hsien (TW)

( * ) Notice: Subject to any disclaimer, the term of this patent is extended or adjusted under 35 U.S.C. 154(b) by 14 days.

(21) Appl. No.: 10/174,712

(22) Filed: Jun. 20, 2002

(51) Int. Cl.[7] ..... A63B 69/06; A63B 26/00
(52) U.S. Cl. ..... 482/57; 482/142
(58) Field of Search ..... 482/51, 57–65, 482/72, 73, 140, 148, 142, 95–96

(56) References Cited

U.S. PATENT DOCUMENTS 3,750,479 A * 8/1973 Gause et al. ..... 73/379.07
4,746,112 A * 5/1988 Fayal ..... 482/73
5,547,443 A * 8/1996 Chen ..... 482/72
5,605,526 A * 2/1997 Hatfield ..... 482/142
5,833,582 A * 11/1998 Chen ..... 482/57
5,941,806 A * 8/1999 Olschansky et al. ..... 482/140

* cited by examiner

*Primary Examiner*—Stephen R. Crow
(74) *Attorney, Agent, or Firm*—Harrison & Egbert

(57) ABSTRACT

An exercise machine includes a base, a seat mounted on the base and provided with a backrest, a leg-exercising mechanism mounted on the base, and two hand grips connected to the leg-exercising mechanism. The seat and the backrest are provided with two rocking frames fastened thereto. The rocking frames are provided with a straight support portion, and an arcuate portion capable of a rocking act to cause the backrest to rest on a floor surface by the straight support portion of the rocking frames. The arcuate portion is further capable of the rocking act to cause the backrest to revert to the previous upright position relative to the floor surface.

2 Claims, 5 Drawing Sheets

EXERCISE MACHINE PROVIDED WITH MEANS TO ENABLE A USER THEREOF TO ASSUME INTERCHANGEABLY A SEATED POSITION AND AN INVERTED POSITION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise machine, and more particularly to an exercise machine designed to enable its user to assume interchangeably a seated position and an upside-down position so as to enhance the exercise effect.

BACKGROUND OF THE INVENTION

The conventional exercise machines are generally so designed that they are used by exercisers in a standing or seated position. It is believed that the effect of exercise is further enhanced by calling for the exercisers to assume an upside-down position. None of the conventional exercise machines is designed to enable an exerciser to assume an inverted position at the same time that the exerciser is doing exercise.

BRIEF SUMMARY OF THE INVENTION

The primary objective of the present invention is to provide an exercise machine with means to allow a user thereof to assume interchangeably a seated position and an upside-down position.

In keeping with the principle of the present invention, the foregoing objective of the present invention is attained by an exercise machine comprising a base, a seat mounted on the base, a leg-exercising mechanism mounted on the base, and two hand grips connected to the leg-exercising mechanism. The present invention is characterized by the seat which is provided with two rocking frames, each having a top portion, a bottom portion, an arcuate portion, and a support portion. The top portion is fastened with the backrest. The bottom portion is fastened with the underside of the seat. The arcuate portion is extended from the bottom portion. The support portion is located between the arcuate portion and the top portion. By virtue of the rocking action of the arcuate portion, the exercise machine can be caused to rest in its entirety on a floor surface by the support portions of the two rocking frames.

The features and the functions of the present invention I will be more readily understood upon a thoughtful deliberation of the following detailed description of two preferred embodiments of the present invention with reference to the accompanying drawings.

DETAILED DESCRIPTION OF THE INVENTION

Figure 1:
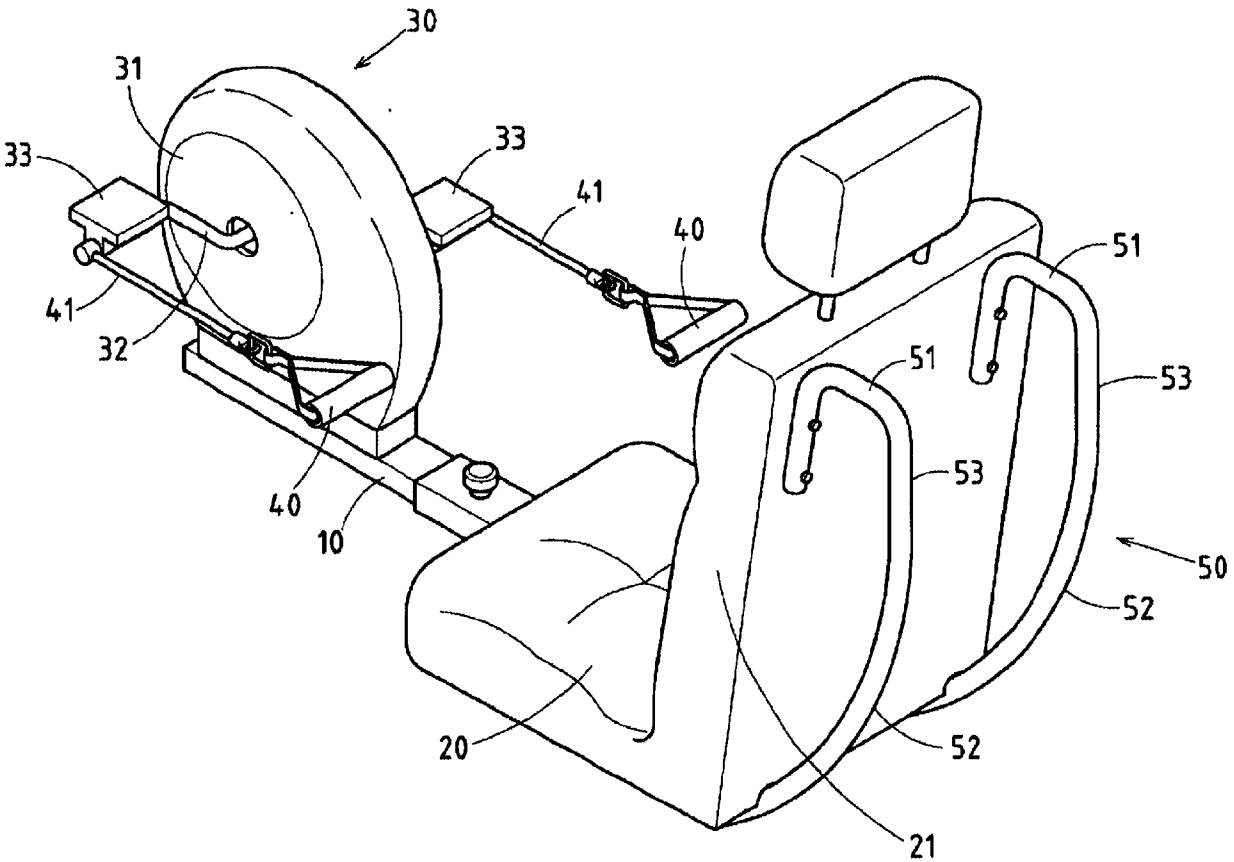
FIG. 1 shows a perspective view of a first preferred embodiment of the present invention.
Figure 2:
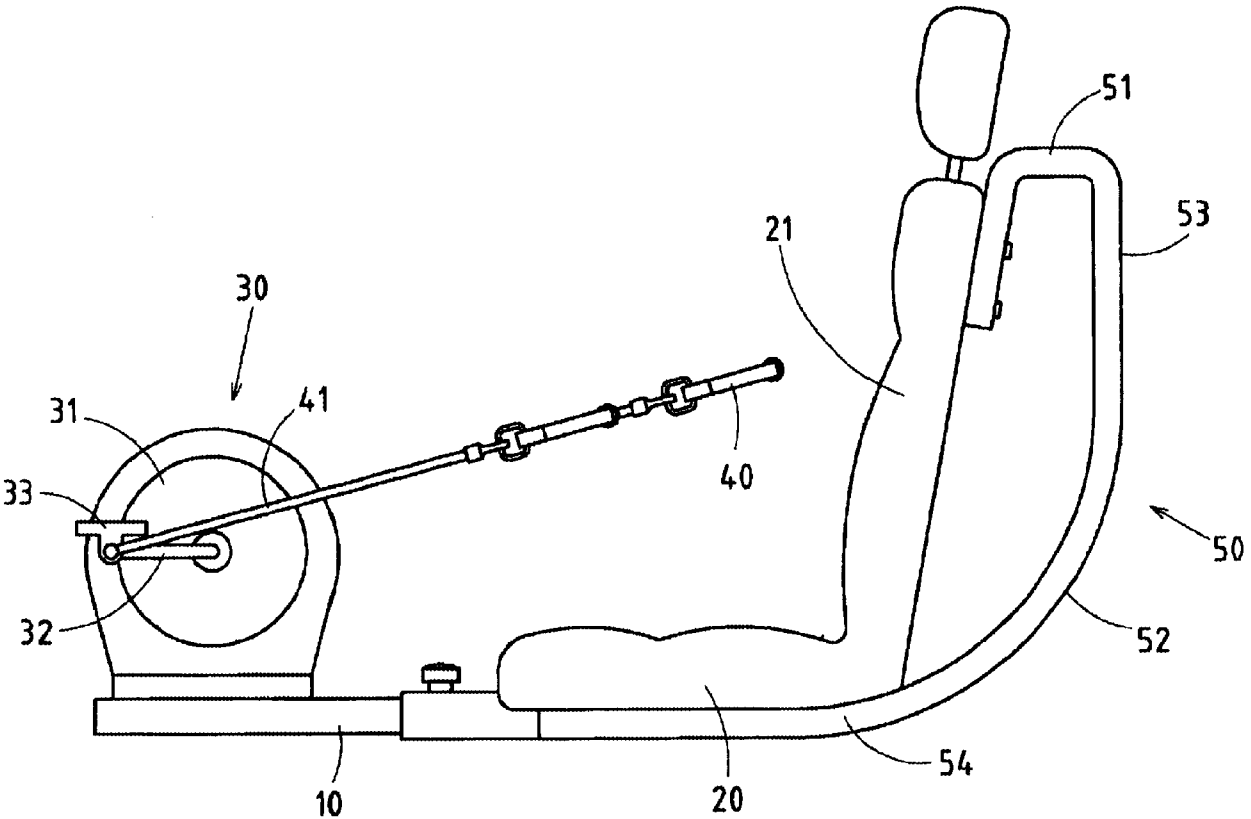
FIG. 2 shows a side schematic view of the first preferred embodiment of the present invention.

As shown in FIGS. 14, an exercise machine of the first preferred embodiment of the present invention comprises a base 10, a seat 20 having a backrest 21, a leg-exercising mechanism 30, and two hand grips 40.

The base 10 is rested on the floor surface. The seat 20 is mounted on one end of the base 10. The leg-exercising mechanism 30 is mounted on the other end of the base and is formed of a damping device 31, two crank arms 32, and two pedals 33 fastened respectively to the two crank arms 32. The two hand grips 40 are connected to the crank arms 32 by-an elastic pull cord 41.

The exercise machine of the present invention is characterized by the seat 20, which is provided with two rocking frames 50, which are fastened to the underside of the seat 20 and an outer side of the backrest 21. The two rocking frames 50 are similar in construction to each other, with each being a rod-shaped construction and having an L-shaped top segment 51, a straight bottom segment 54, an arcuate segment 52 extending from the straight bottom segment 54, and a straight support segment 53 located between the arcuate segment 52 and the L-shaped top portion 51. The arcuate segment 52 has a radian corresponding to one fourth of a circular radian. The arcuate segment 52 is similar in function to a rocker capable of a rocking motion.

Figure 3:
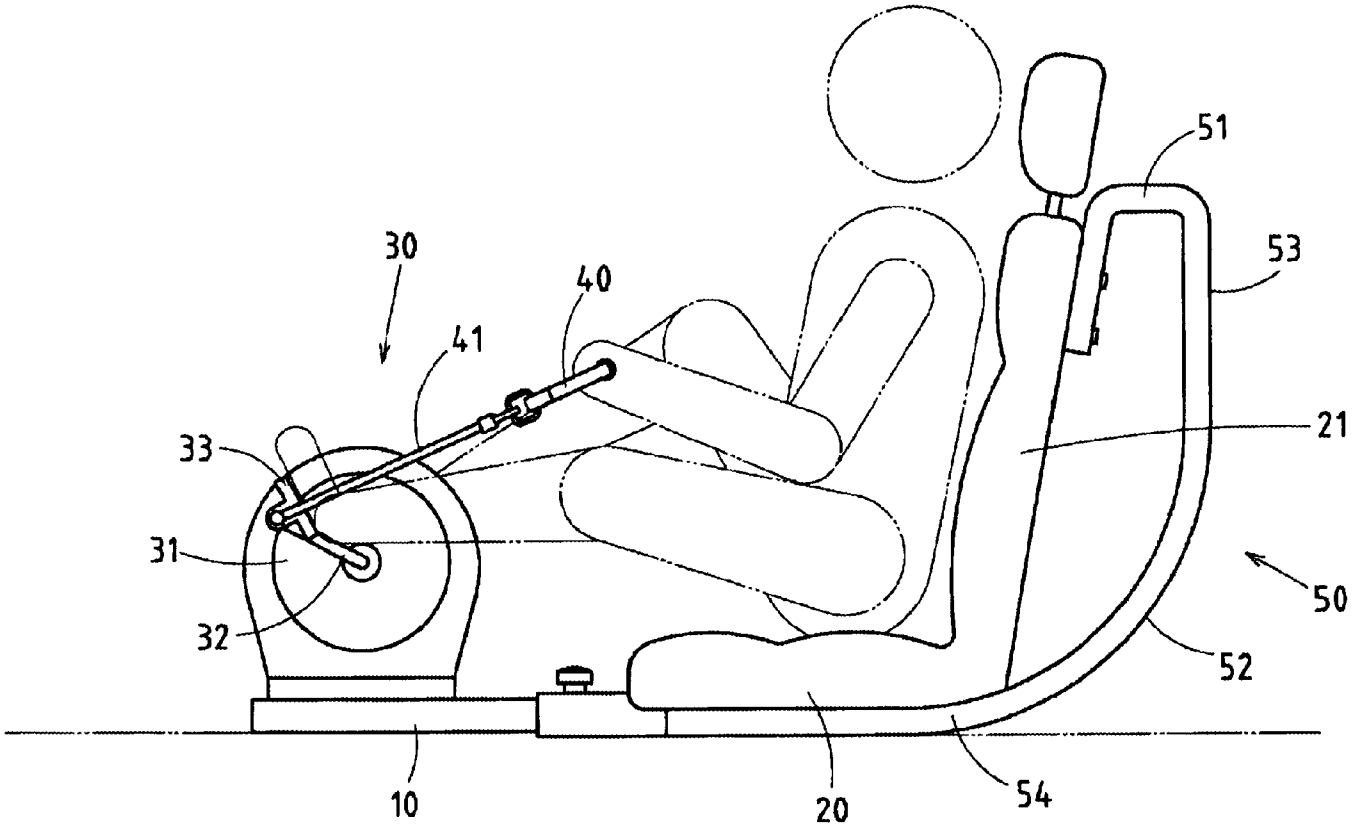
FIG. 3 shows a side schematic view of the first preferred embodiment of the present invention in action with a user being in a seated position.
Figure 4:
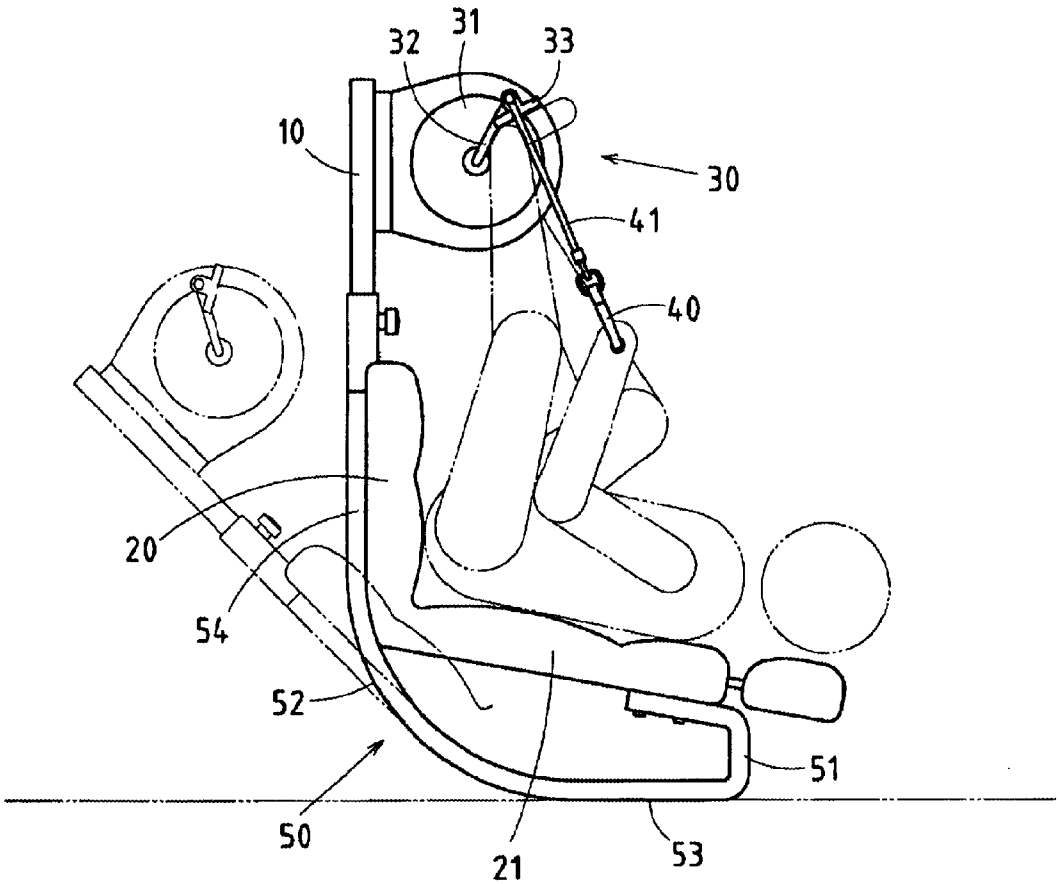
FIG. 4 shows a side schematic view of the first preferred embodiment of the present invention in action with a user being in an upside-down position.

As illustrated in FIG. 3. a user of the exercise machine of the present invention is doing exercise in a seated position. The user may do the exercise in an upside-down position by pressing his or her back against the backrest 21 so as to cause the backrest 21 to move toward the floor surface by virtue of the rocking act of the arcuate segments 52 of the two rocking frames 50. As a result, the backrest 21 is rested on the floor surface by the straight support segments 53 of the rocking frames 50, as shown in FIG. 4. In the meantime, the base 10 and the seat 20 are caused to move away from the floor surface to be located uprightly. As the user of the exercise machine is in the inverted position, the exercise effect on the leg muscles of user is greatly enhanced. The upside-down position of the user can be returned to the seated position by moving the back of the user away from the backrest 21 so as to rest the user's weight on the seat 20. By virtue of the rocking act of the arcuate segments 52 of the rocking frames 50, the base 10 is reverted to the former position in contact with the floor surface, as shown in FIG. 3.

Figure 5:
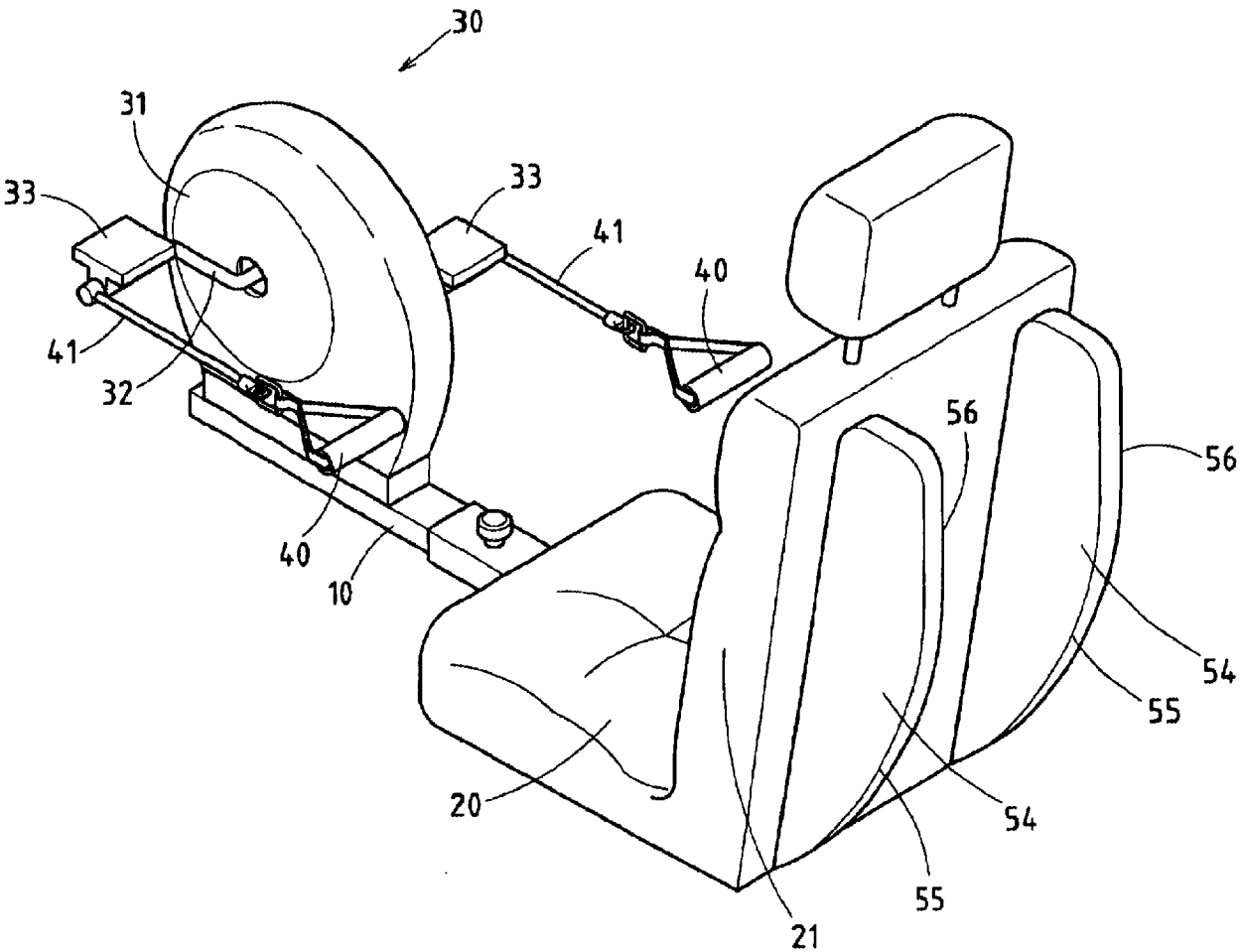
FIG. 5 shows a perspective view of a second preferred embodiment of the present invention.

As shown in FIG. 5, the second preferred embodiment is similar in construction to the first preferred embodiment, except that the former comprises two rocking frames 54, each being a slat in place of a curved rod of the first preferred embodiment. The two slats 54 are fastened to the underside of the seat 20 and the outer side of the backrest 21. The slats 54 have an arcuate portion 55 and a straight support portion 56. The rocking act is brought about by the arcuate portions 55 of the slats 54. The backrest 21 is rested on the floor surface by the two straight support portions 56 of the two slats 54. The arcuate portions 55 have a radian corresponding to one fourth of a circular radian.

As illustrated in FIG. 4, a strenuous exercise is brought about for the purpose of training and developing the body of a user in the upside-down position.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. An exercise machine comprising:

a base rested on a floor surface;

a seat mounted on one end of said base;

a backrest extending from said seat;

a leg-exercising mechanism mounted on an opposite end of said base such that said leg-exercising mechanism is opposite to said seat, said leg-exercising mechanism comprising two crank arms, a damping device, and two pedals fastened to said two crank arms; and two hand grips connected to said two crank arms by an elastic pull cord;

wherein said seat and said backrest are comprised of two rocking frames, each frame comprising a curved rod with a top segment, a straight bottom segment, an arcuate segment extending from said straight bottom segment, and a straight support segment located between said top segment and said arcuate segment, said top segment being fastened to an outer side of said backrest, said straight bottom segment being fastened to an underside of said seat, said arcuate segment having a radian corresponding to one fourth of a circular radian whereby said arcuate segment is capable of a rocking act to cause said backrest to rest on the floor surface by said straight support segment at such time when an inner side of said backrest is exerted on by a force of a person seated on said seat, said arcuate segment further being capable of the rocking act to cause said seat to rest on the floor surface by said straight bottom segment at such time when said seat is exerted on by a force of the person seated on said seat.

2. The exercise machine as defined in claim 1, wherein each of said two rocking frames is a slat whereby said slat is fastened to the outer side of said backrest and the underside of said seat and is comprised of an arcuate portion and a straight support portion, said arcuate portion having a radian corresponding to one fourth of the circular radian, said arcuate portion being capable of a rocking act to cause said backrest to rest on the floor surface by said straight support portion at such time when said backrest is exerted on by a force of a person seated on said seat, said arcuate portion further being capable of the rocking act to cause said seat to rest on the floor surface at such time when said seat is exerted on by a force of the person seated on said seat.

* * * * *